United States Patent [19]

Gouley

[11] 4,153,240

[45] May 8, 1979

[54] AUTOMATIC TRANSFER APPARATUS

[75] Inventor: Gilbert M. Gouley, Saint-Andres-les-Vergers, France

[73] Assignee: Agence Nationale de Valorisation de la Recherche, Neuilly-sur-Seine, France

[21] Appl. No.: 789,986

[22] Filed: Apr. 22, 1977

[30] Foreign Application Priority Data

Apr. 26, 1976 [FR] France ..... 76 12318

[51] Int. Cl.[2] ..... B65G 59/02

[52] U.S. Cl. ..... 270/68 R; 271/33; 414/120; 414/18; 414/729

[58] Field of Search ..... 271/33, 18.3, 168; 214/1 B, 1 BB, 1 BD, 1 S, 8.5 R, 8.5 A, 1 Q, 8.5 C, 8.5 D, 8.5 G; 270/61 R, 78, 68 R

[56] References Cited

U.S. PATENT DOCUMENTS

| | | | |
|---|---|---|---|
| 2,034,771 | 3/1936 | Remington | 270/61 R X |
| 2,351,367 | 6/1944 | Rider | 271/33 |
| 3,083,961 | 4/1963 | Arbter | 271/33 |
| 3,109,642 | 11/1963 | Flynn | 270/61 R |
| 3,635,463 | 1/1972 | Stobb | 214/8.5 A X |
| 3,738,645 | 6/1973 | Gray et al. | 271/168 X |
| 3,785,638 | 1/1974 | Beazley | 271/33 |
| 3,913,906 | 10/1975 | Vits | 270/69 X |

FOREIGN PATENT DOCUMENTS

| | | | |
|---|---|---|---|
| 2136502 | 12/1972 | France | 270/68 R |
| 961371 | 6/1964 | United Kingdom | 271/33 |

*Primary Examiner*—Frank E. Werner
*Attorney, Agent, or Firm*—Lewis H. Eslinger

[57] ABSTRACT

An automatic transfer apparatus for transferring articles stacked on a platform, one by one, to a table comprising a gripping head, a gripping finger mounted for vertical movement relative to a support on the gripping head, a drive for moving the support together with the gripper finger backwards and forwards over the platform and the table, second drive for moving the gripper finger into and out of engagement with the article on top of the stack and an adhesive member on the gripping finger for engaging and holding the article.

12 Claims, 18 Drawing Figures

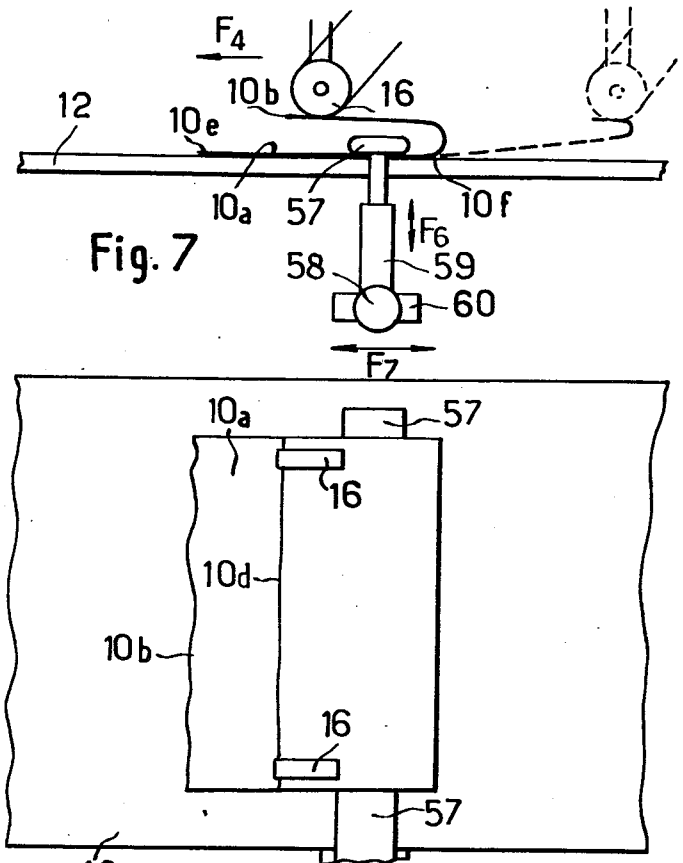
Fig. 7
Fig. 8
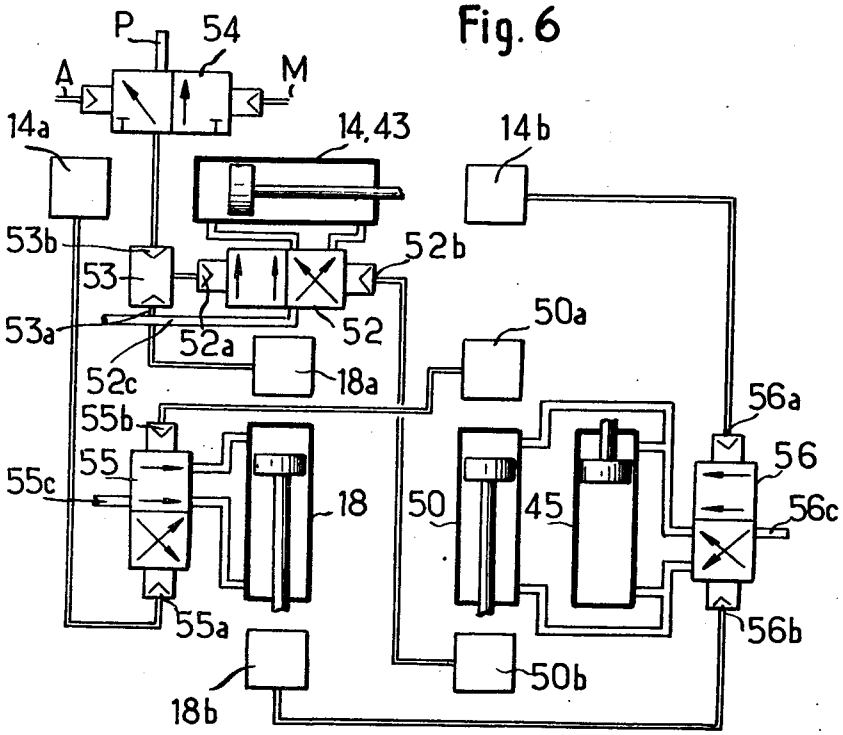
Fig. 6

AUTOMATIC TRANSFER APPARATUS

BACKGROUND OF THE INVENTION

The present invention relates to automatic apparatus for gripping of articles or elements, particularly textile elements. More particularly the present invention relates to an apparatus for automatically and sucessively taking hold of elements or articles in a stack on a horizontal platform one by one and placing these on a surface or table, for example an apparatus for transferring textile elements, such as pieces of knitted wear, one by one on to the table of a sewing machine.

Automation of the different phases in putting together articles made of textiles is in great demand, particularly for the manipulation and transfer phases so as to effect economies in terms of labour and to eliminate manual work, the repetitive character of which often makes it tedious.

SUMMARY OF THE INVENTION

It is an object of the present invention to provide an automatic apparatus of the type defined above which particularly makes it possible to bring textile elements stacked on a platform one by one to a work area.

According to the invention, there is provided an automatic transfer apparatus for transferring articles stacked on a platform one by one on to the table, the apparatus comprising a gripping head including support means, a gripping finger mounted for vertical movement relative to said support means, first drive means connected to said support means for moving said support means backwards and forwards over the platform and table between a rear position and a forward position, second drive means for moving said gripping finger vertically relative to said support means from or to a gripping position in which it can contact the article on top of the stack, and adhesive means on said gripping finger for engaging and holding said article on top of the stack.

BRIEF DESCRIPTION OF THE DRAWINGS

The invention will now be described in greater detail, by way of example, with reference to the drawings in which:

FIG. 6 is a diagram of a pneumatic control circuit for the apparatus shown in FIGS. 1 and 2;

FIG. 7 shows a partial elevational side view of an embodiment of the apparatus shown in FIG. 1 for transferring unflded elements picked up from a stack and moved folded in half on to a table;

FIG. 8 shows a partial plan view of the embodiment of the apparatus shown in FIG. 7;

DESCRIPTION OF THE PREFERRED EMBODIMENT

Figure 1:
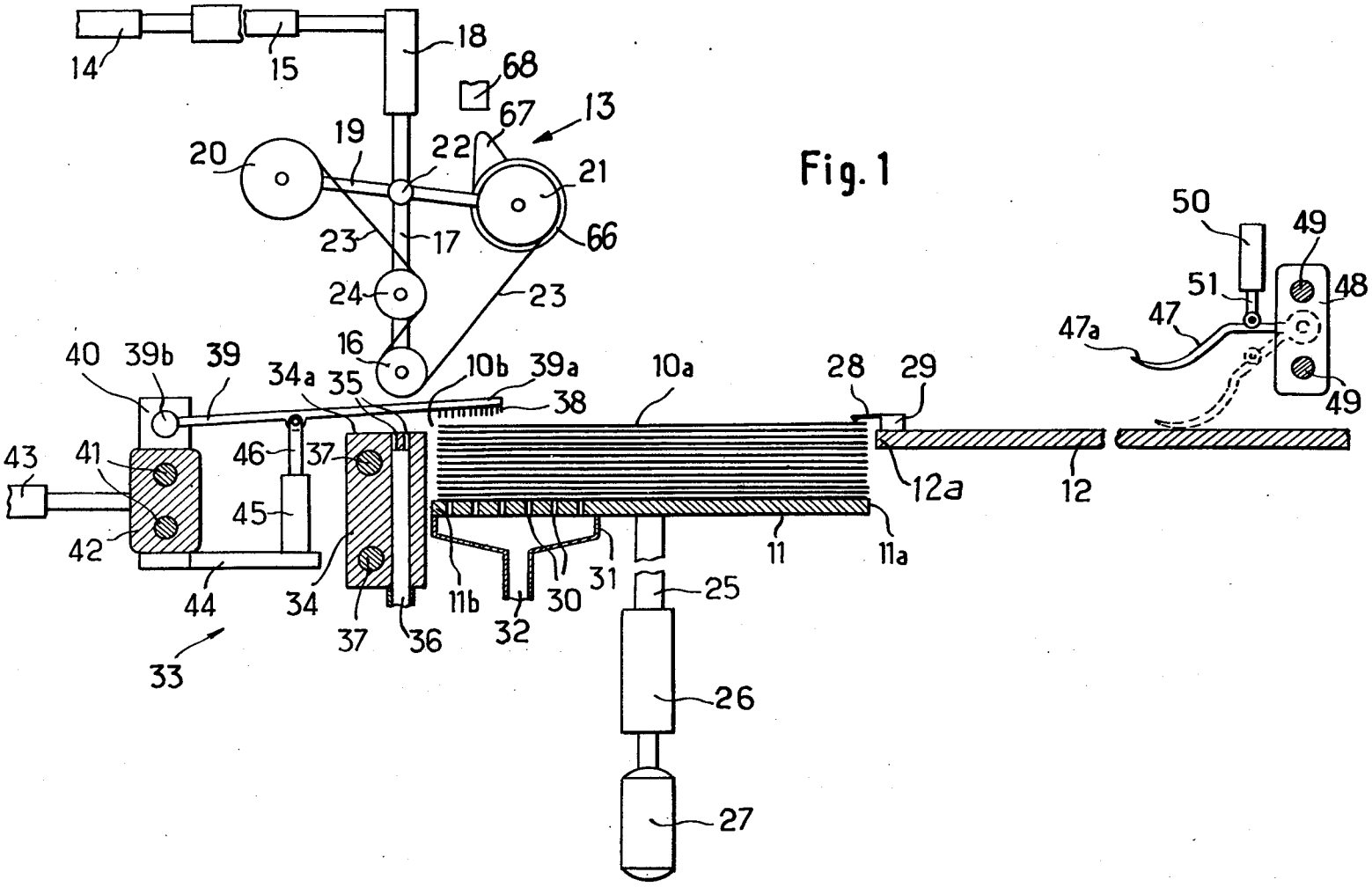
FIG. 1 is an elevational side view in section of a preferred embodiment of an apparatus in accordance with the invention.

In accordance with a preferred embodiment of the invention, the apparatus comprises at least one gripping head consisting of a movable support member and a gripping finger mounted vertically in relation to the support member, at the extremity of a movable rod; first drive means coupled to the support member for displacing the gripping finger along an outward and return path above the platform and the table between a position which is called a rear position and a position which is called a front position for the purpose of which the gripping finger overhangs the table; second drive means coupled to the rod for displacing the gripping finger to and from a gripping position in which it is capable of coming into contact with the first element or article of a stack resting on the platform; adhesive means for making a connection by means of pressure between the gripping finger and the said first element or article for gripping this first element and for transferring it as far as the table; and means for breaking this connection by means of traction when said element or article has been transferred to the said table.

Vertical displacement of the gripping finger after it has been brought against the stack makes it possible to separate the first element from the rest of the stack before transferring the latter by means of displacement of the gripping finger towards the front position.

The adhesive means for establishing a connection between the gripping finger and an element to be transferred are constituted by any adhesive type means making it possible to establish, between the gripping finger and the element, a temporary connection which is sufficient to ensure transportation of the element, permitting gripping of the element without deterioration or marking of the latter and capable of being easily broken after transfer of the element.

Preferably, an adhesive strip applied to the gripping finger by its non-adhesive side is used. Breaking the connection is simply carried out by means of traction by means of at least one retaining member capable of being applied to this element and of keeping it against the table during return of the gripping finger.

Other means of adhesive type may be used. For example, the gripping finger may be provided with a hooking strip having a hooking force which is high with respect to the surface of the textile element, for example the piece of knitted wear, the connection being made as previously, by pressure and being broken by traction.

In order to avoid the next element being entrained by adhesion during transfer of the first element of the stack or to avoid several elements situated below this first element of the stack from being entrained, the platform is pierced by orifices opening on to its upper surfaces and connected to a suction pipe. Transfer of each element between the platform and the table is carried out preferably horizontally. In addition, a drive device capable of displacing the platform in a vertical manner and detection means capable of delivering a stop signal to the drive device in such a manner as to bring the first element of a stack lying on the platform each time, just above a predetermined horizontal plane is provided in an advantageous manner.

When the elements of the stack have a large tendency to adhere to each other, it is advantageous to separate the first element of the stack at least partially from the rest of the stack before gripping by the gripping finger.

This may be carried out by means of a device for separating the first element of a stack resting on the platform, said device comprising: a support block adjacent the edge of the platform opposite to the side adjacent the table, the upper surface of which extends in the horizontal plane, at least one gripping element which is movable between a first position above the support block and a second position above an edge area, situated on the side of the said edge of the platform, of the first element of a stack resting on the platform in order to take hold of the said first element and shift it laterially of the rest of the stack by bringing the said edge region above the said support block. An element capable of displacing the first element by means of adhesion is used as the gripping element and is obtained by simple contact with possible pressure. The gripping element could comprise the gripping finger provided with an adhesive strip.

For textile elements this separation element is for example constituted by a brush fixed to one extremity of a rod for carrying the brush, which rod is pivotally mounted, in order to be able to lower and raise the brush, on a support element which is movable and may be conveyed horizontally in order to displace the brush between first and second positions. In this case the drive means for the gripping finger are capable of displacing the latter in order to bring it into a gripping position against the said edge region of the element resting on the support block.

According to a first special embodiment, the apparatus in accordance with the invention makes it possible to take hold of elements successively one by one, these elements resting in a stack and being spread out on the platform and makes it possible to displace these in spread out manner on to the table. Preferably the drive means for the gripping finger are arranged so as to bring it into a gripping position close to one edge of the elements to be transferred extending transversely in relation to the direction of transfer of these elements, preferably the edge which is most remote from the table.

According to a second special embodiment of the apparatus in accordance with the invention, the latter makes it possible to take hold of the spread out elements and displace them on to the table folded in two.

In order to do this, the drive means of the gripping finger are arranged so as to bring the latter into a gripping position substantially at the level of the line of folding of the first element of a stack resting on the platform. This may be carried out provided that the stacked elements to be transferred do not adhere together.

If on the other hand, adhesion between these elements is such that the first element of the stack, when transported, risks taking one or several others along with it then apparatus provided with the separation device is preferably used and in order to move the element folded in two on to the table, special means for breaking the connection between the gripping finger and the element transferred are provided, these means comprising a bar which may be moved above the table, first means for displacing the bar transversely in relation to the direction of displacement of the pieces transferred between a first position, in which it is moved aside from the transfer region of the elements on the table, and a second position in which it overhangs the said transfer region and is situated on the platform side in relation to the front position of the gripping finger, and second means for applying the bar against the table when it is in the second position.

Finally, according to a third special embodiment of the apparatus in accordance with the invention, the latter makes it possible to take hold of the elements resting on the platform and folded in two successively one by one, by their fold which extends substantially perpendicular to the direction of transfer of the elements between the platform and the table and which is situated on the platform side opposite the side situated nearest to the table, and makes it possible to move these elements folded in two on to the table. In this case the drive means for the gripping finger are arranged so as to bring the latter into the gripping position at an adjacent zone to the fold of the first element of a stack resting on the platform.

Figure 2:
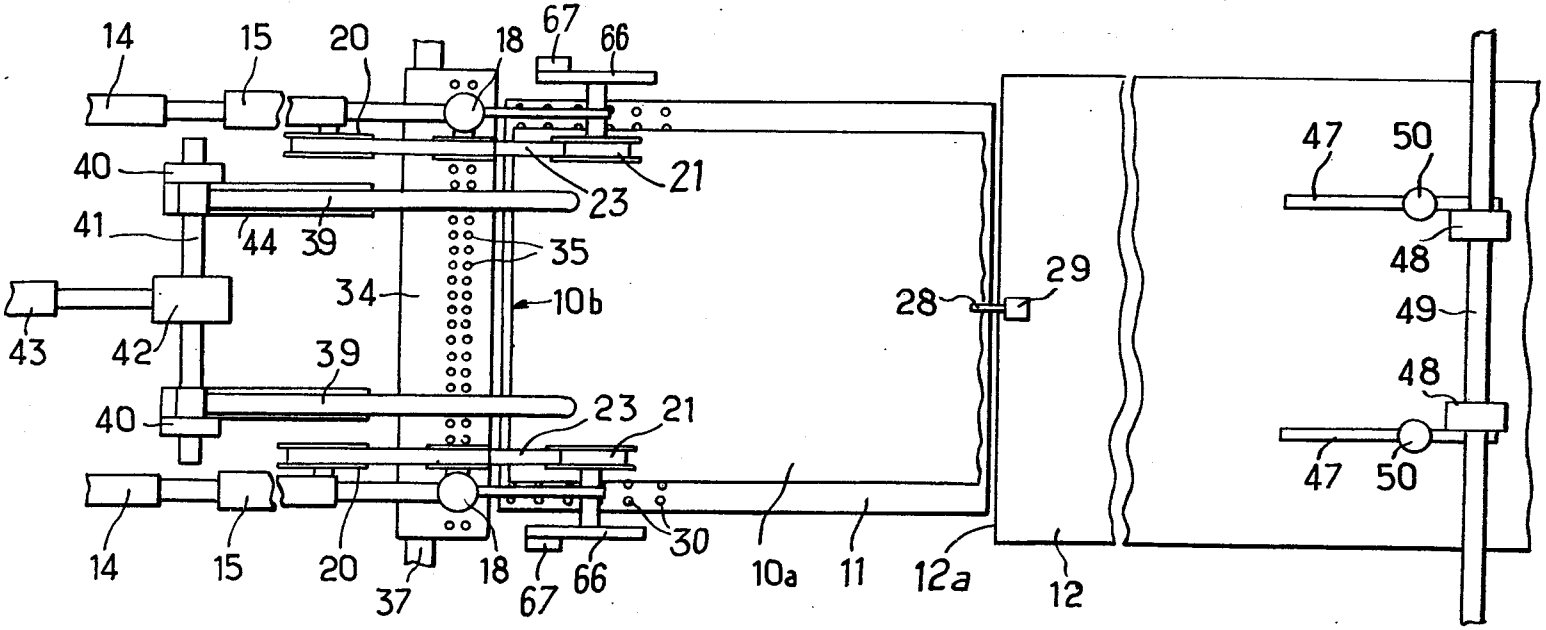
FIG. 2 is a plan view of the apparatus shown in FIG. 1.
Figure 5:
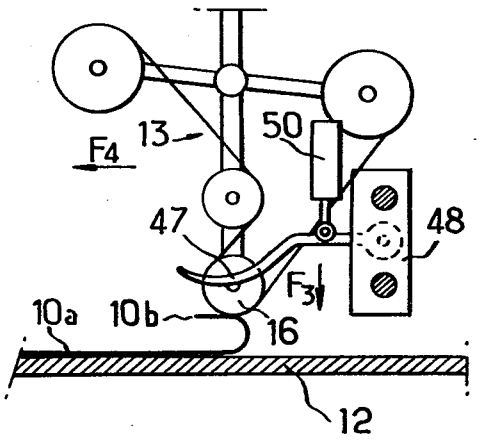
FIGS. 3, 4 and 5 are three successive partial side views of the apparatus shown in FIG. 1 respectively showing successive phases of transfer of a spread out element which has been picked up from a stack (FIGS. 3 and 4) and placed unfolded on a table (FIG. 5)

Referring to the drawings, the apparatus shown in FIGS. 1 and 2 is designed to transfer textile elements 10 one by one, stacked on a horizontal platform 11, on to a horizontal table 12. These elements are pieces of knitted wear for example which have to be brought on to the table of a sewing machine.

Two gripping heads 13 are mounted for horizontal movement above the platform 11 and the table 12, being conveyed horizontally, under the action of jacks 14 and by means of telescopic slides 15. The two gripping heads are displaced in parallel manner with regard to each other and in synchronism and are aligned in a direction which is perpendicular to that of their horizontal displacement.

Each gripping head 13 carries a gripping finger 16 at the lower end of a vertical rod 17 which is moved vertically under the action of a jack 18, the body of which is fixed to the end of a slide 15.

Each gripping finger 16 is made in the form of a freely mounted pulley rotating about a horizontal axis perpendicular to the horizontal direction of displacement of the gripping heads 13.

Each gripping head carries an arm 19 at the ends of which are mounted take-off rollers 20 and a rewinding roller 21, and which is articulated between its ends about a pivot axis 22 carried by the rod 17 and parallel to the axis of the pulley-gripping finger 16.

An adhesive strip 23 is unwound from the rollers 20, passes on to a return pulley 24 and is then guided by its non-adhesive face on to the gripping finger 16 and finally is taken up again by the roller 21. The rollers 20 and 21, the pulley 24 and the gripping finger 16 have parallel axes.

The platform 11 has a side 11*a* situated close to the front edge 12*a* of the table 12 and is moved vertically such that the first element 10*a* of the stack carried by the platform is located in a horizontal plane substantially identical to that of the upper face of the table 12. The platform 11 is supported by a post 25 coupled by a screw transmission 26 to an electric motor 27 so as to allow the platform to be lifted until the first element 10*a* actuates a fixed switch 29 a mobile arm 28 by means of which causes the motor 27 to stop.

The platform 11 is pierced by orifices 30 at least in its part situated along the side 11*b* opposite the side 11*a*, those orifices 30 opening at its upper surface and being connected by means of a hod 31 and a suction pipe 32 situated at the lower face of the platform to a suction device not shown.

A separation device 33 is mounted along the side 11*b* of platform 11. This device comprises a suction block 34 extending parallel to the side 11*b* of the platform and having orifices 35 along its length which open at its upper surface 34*a* which is situated at the level of the table 12 and connected to the suction device by means of a suction pipe 36.

The suction block 34 is slidably mounted on horizontal rods 37 which are parallel to the side 11*b* of the platform and perpendicular to the direction of horizontal displacement of the gripping heads 13.

The separation device comprises, moreover, two brushes 38 fixed to the ends 39*a* of rods 39 which carry the brush and are mounted so as to pivot at their other ends 39*b* on support elements 40. The support elements 40 are slidably mounted on rods 41 parallel to the rods 37 and are carried by a unit 42 moving horizontally under the action of a jack 43 in a direction perpendicular to the rods 41.

Each support element 40 comprises a flat horizontal plate 44 which carries a jack 45, the piston rod 46 of which is articulated at its extremity to the rod 39 carrying the brush.

Above the table 12 is arranged a device for retaining the elements transferred comprising two liftable arms 47 pivoted on support elements 48 slidably mounted on rods 49 which extend in a perpendicular manner to the horizontal direction of displacement of the gripping heads 13. Each liftable arm 47 may pivot under the action of a jack 50, the piston rod 51 of which is pivoted on this arm in order to rest by its free end 47*a* against the surface of the table 12 (as shown in broken lines in FIG. 1).

The textile elements 10 being stacked on the platform 11 with an edge 10*b* extending parallel to the side 11*b* and the length of the latter, operation of the apparatus is as follows (FIGS. 1, 3, 4 and 5).

Under the action of the jacks 43, the brushes 38 are brought into the front position above the first element 10*a* of the stack adjacent its edge 10*b* (FIG. 1) and are then applied against this element by the jacks 46.

Figure 3:
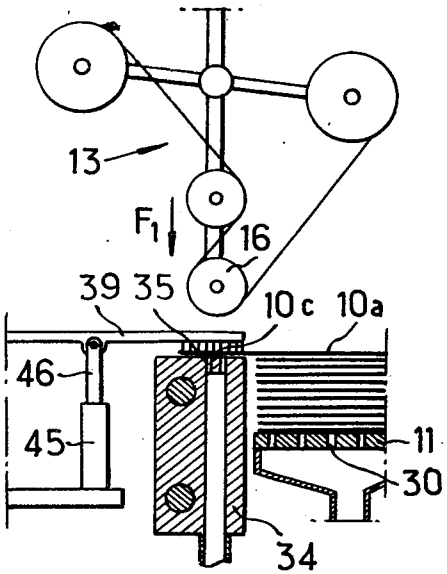

The brushes 38 are brought into the rear position by the jacks 43 and pull the element 10*a* in order to separate and shift it laterally of the rest of the stack until they bring the region 10*c* of this element adjacent the end 10*b* on to the suction unit 34 above the orifices 35 (FIG. 3). The other elements of the stack remain in place on the platform 11 as a result of suction through the orifices 30.

The gripping heads 13 being in their rear position (FIGS. 1, 2 and 3), the gripping fingers 16 are lowered vertically by the jacks 18 (arrow $F_1$ of FIG. 3) in order to be applied in the gripping position against the element 10*a* at the level of the region 10*c*. It will be noted that the gripping fingers 16 come against the element 10*a* at different places from those where the brushes 38 are applied, and preferably in the end regions of the edges 10*b*. The positions of the gripping heads 13 are advantageously controlled as a function of the length of the edge 10*b* of the elements 10 to be transferred in accordance with the direction in which they are aligned, by adopting, for example, for the jack supports 14, an assembly on the sliding units on rods, a similar assembly to that of the support elements 40 and 48. In the example shown the positions of the brushes 38 on the element 10*a* are chosen close to the positions of gripping of the gripping fingers 16 by regulating the position of the support elements 40 on the rods 41.

Figure 4:
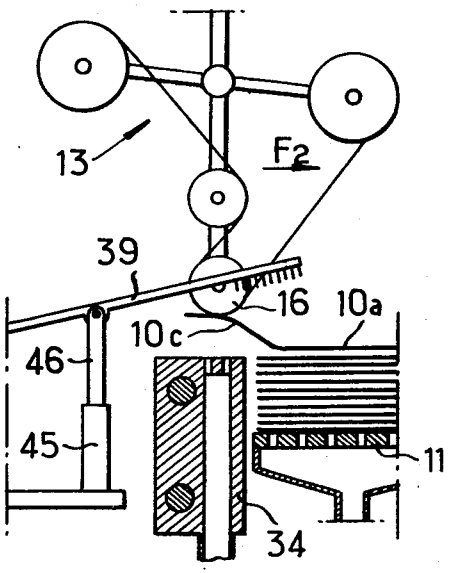

The gripping fingers 16, being in a gripping position, the brushes 38 being raised again by the jacks 39 and then the gripping fingers 16 are raised again by the jacks 18 (FIG. 4).

The gripping heads 13 are thus displaced towards their front position (arrow $F_2$ of FIG. 4) and carry along the element 10*a* by its edge region 10*c*.

The element 10*a* reaches the table 12 by being turned over. It will be noted that transportation of the element 10*a* by turning it over makes it possible to unstick it from the next lowest element of the stack inasmuch as the elements placed one on top of the other have a tendency to stick together. On the contrary, if the element 10*a* was picked up along its edge closest to the table 12 there would be the risk of taking the element of the stack situated therebelow along with it as a result of friction when transfer takes place.

The gripping heads 13, having reached their front position (FIG. 5) bring the edge region 10*c* of the element 10*a* below the liftable arms 47. These latter are then lowered towards the table 12 by the jacks 50 (arrow $F_3$ of FIG. 5). It is possible to control the position of the liftable arms 47 such that they are applied against the element 10*a* adjacent the gripping fingers 16 of the gripping heads in the front position. Lowering the liftable arms may be sufficient to unstick the element 10*a* from the gripping fingers. If not, this unsticking takes place during the course of return of the gripping heads (arrow $F_4$ of FIG. 5), the element 10*a* being firmly retained against the table 12 by the liftable arms 47.

The gripping heads 13 return to the rear position for transfer of a new element separated from the stack after raising the platform 11. It will be noted that in the example shown, the switch 29 is fixed on the table 12. In addition, as soon as the element 10*a* is separated and drawn on to the suction unit 34 the movable contact arm 28 is freed and the platform 11 is raised.

It will be noticed that if two elements are carried along by the suction unit 34 during the course of the separation phase only the upper element will be taken hold of by the gripping fingers 16, the lower element will remain stuck to the unit by means of suction exercised across the orifices 35

In FIG. 6 a circuit diagram of control of the apparatus is shown by way of example and is in fact a pneumatic control circuit.

The jacks 14, 18, 43, and 50 are double-acting jacks fed by distributors.

Thus the jacks 14 and the jack 43 are supplied in parallel by the same distributor 52 which, at its control input 52*b*, receives a control signal delivered by a detector 50b when the arms 47 are in a low position and at its control input 52a receives a control signal delivered by a logic AND circuit 53. This AND-circuit receives a control signal delivered by a detector 18a at an input 53a when the gripping fingers 16 are in a high position and transmits this signal when its second input 53b is placed at the suitable logic level by actuation of a start-stop valve 54 on the apparatus.

This valve, in its start position M, connects the input 53b to the high pressure level P and in its stop position A connects the input 53b to the atmosphere.

The jacks 18 are supplied in parallel by the same distributor 55 which receives a control signal delivered by a detector 50a to its control input 55b, when the arms 47 are in a high position and, receives a control signal delivered by a detector 14a to its control input 55a when the gripping heads 13 are in a rear position.

Finally, the jacks 46 and 50 are supplied in parallel by the same distributor 56 which receives a control signal delivered by a detector 18b at its control input 56b when the gripping fingers 16 are in allow position and receives a control signal delivered by a detector 14b at its control input 56a when the gripping heads 13 are in a forward position.

Each distributor 52, 55, 56 is connected to the source of air under pressure by a pipe, respectively 52c, 55c, 56c and alternately puts the chambers of the jacks which it controls under pressure and exhaust.

Each detector 14a, 14b, 18a, 18b, 50a, 50b is an end-of-travel detector for the pistons of the jacks 14, 18, 50 or an element integral in movement with this piston, for example a pneumatic leak detector.

With this type of control circuit, functioning of the apparatus is as follows.

The gripping heads 13 and the brushes 38 are displaced simultaneously towards their forward positions when the gripping fingers 16 reach their high position.

When the gripping heads 13 reach their forward position, the brushes 38 and the arms 47 are lowered simultaneously.

As soon as the arms 47 are in a low position the gripping heads 13 and the brushes 38 are displaced towards their rear positions.

When the gripping heads 13 are in their rear position the gripping fingers 16 are lowered. The latter having reached their low position, the arms 47 and the brushes 38 are simultaneously raised again.

The gripping fingers 16 are then raised again and the apparatus returns into its initial position when the arms 47 have reached a high position.

As the arms 47 are raised again, the element transferred is removed automatically, for example by being slid on the table 12 to a work area.

By way of variation, shifting of the first element of the stack onto the suction unit 34 could be carried out by means of the gripping fingers 16, with suitable control of their movement, these gripping fingers fulfilling therefore the function of brushes 38.

The apparatus described above makes it possible to take hold of the unfolded elements automatically and to move them unfolded on to the table 12.

A modification of the device for retaining these elements on the table 12 makes it possible to move unfolded elements picked up from the platform 11 on to the table 12 folded in two, as illustrated by FIGS. 7 and 8.

Instead of arms 47 and their supports and actuating jacks, a moveable bar 57 is provided on the one hand horizontally and perpendicularly to the direction of displacement of the gripping heads 13 (arrows $F_5$ of FIG. 8), under the action of a jack 58 and on the other hand vertically (arrows $F_6$ of FIG. 7), under the action of at least one jack 59. A jack 58 acts on a second bar 60 which is parallel to the bar 57, is moveable below the table 12 and carries the jack 59. The rest of the apparatus is identical to that illustrated in FIGS. 1 and 2.

The operation is as follows:

The bar 57 being moved aside laterally of the transfer region of the elements on the table, the gripping heads 13 carry out their forward motion. When they have reached the forward position, the bar 57 is brought laterally above the median region of the transferred element 10a, thus on the side of the platform in relation to the gripping fingers 16 in a forward position (position shown in broken lines in FIG. 7). The bar 57 is then lowered towards the table 12 and applies the element 10a against the latter while firmly maintaining it. The gripping heads 13 thus begin their return path (arrow $F_4$ of FIG. 7) and carry out a folding in two of the element 10a along a fold line 10f, the element 10a remaining connected along its edge 10b to the gripping fingers 16 (FIG. 7). The position of the bar parallel to the direction of displacement of the gripping head may be pre-regulated such that when the edge 10b suspended from the gripping fingers 16 reaches the level of the opposite edge 10e resting on the table 12 the folded part of the element 10a is held and is detached from the gripping fingers 16 which continue their return path.

The bar 57 is then raised again and withdrawn to allow the transferred element to be discharged.

Control of the position of the bar 57 may be carried out by mounting the latter such that the support and drive elements on one element may slide in accordance with the arrows $F_7$ (FIGS. 7, 8). This portion is chosen as a result of the desired location of the fold line 10f, this not necessarily being situated in the centre of the element 10a as shown in the example.

Figure 9:
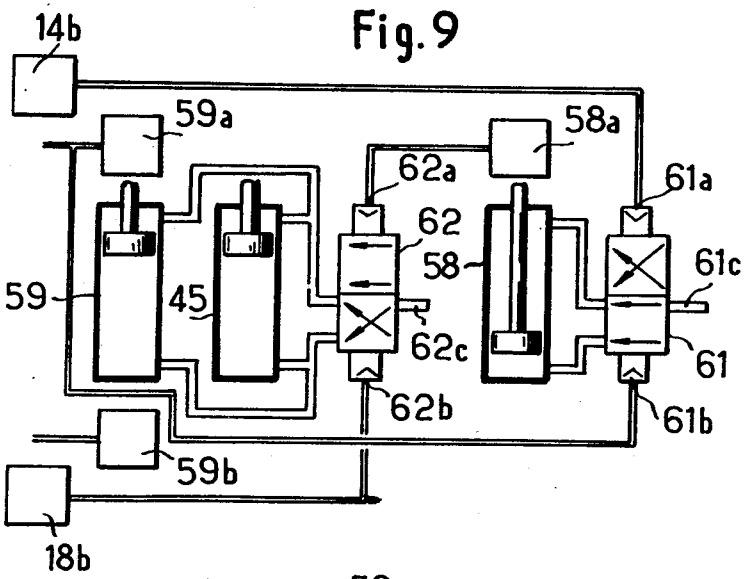
FIG. 9 is a partial view of a pneumatic circuit diagram for controlling the embodiment of the apparatus shown in FIGS. 7 and 8.

FIG. 9 shows a modification of the control circuit of FIG. 6 adapted to the embodiment of the apparatus shown in FIGS. 7 and 8.

The jack 58 is supplied by a distributor 61 connected by a pipe 61c to the source of air under pressure and which receives the control signal delivered by the detector 14a at its control input 61a and receives the control signal delivered by a detector 59a at its control input 61b when the bar 57 reaches a high position.

The jacks 59 and 46 are supplied in parallel by a distributor 62 connected by a pipe 62c to the source of air under pressure and which receives a control signal, delivered by a detector 58a, at the control input 62a when the bar 57 is in its forward position above the table 12 and receives the control signal delivered by the detector 18b on control input 62b.

A detector 59b delivers a control signal when the bar 57 reaches its high position.

The jacks 14, 43 and 18 are controlled, as illustrated in FIG. 6, the detectors 59a and 59b replacing the detectors 50a and 50b. Thus with the control circuit shown in FIG. 9, the bar 57 is brought into its forward position above the table as soon as the gripping heads 13 reach the forward position. The bar 57 is lowered against the table 12 as soon as the forward position has been reached and the brushes 38 are simultaneously lowered.

When the gripping fingers reach the gripping position after their return, the bar 57 is raised with the brushes 58 and as soon as it has attained its high position it is withdrawn laterally at the same time as the brushes 38 are raised again.

FIGS. 10 to 13 show a different embodiment of an apparatus in accordance with the invention for taking hold of unfolded elements resting in a stack and moving them folded in two.

Figure 10:
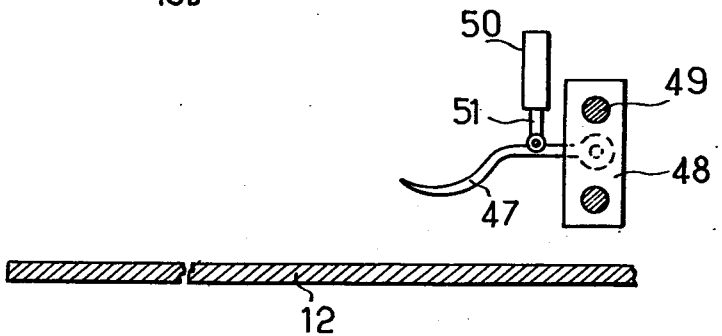
FIG. 10 is an elevational side view in section of an embodiment of an apparatus in accordance with the invention for transferring unfolded elements picked up from a stack and moved folded in half on to a table.
Figure 10:
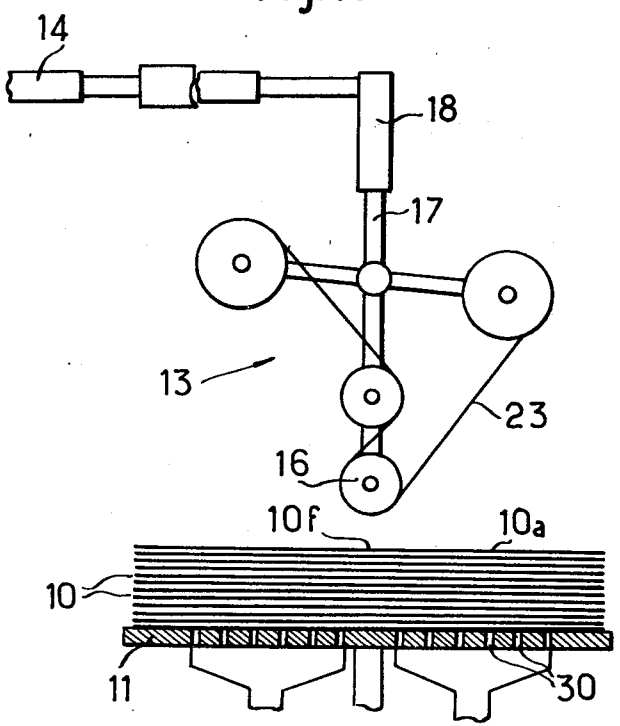
Figure 13:
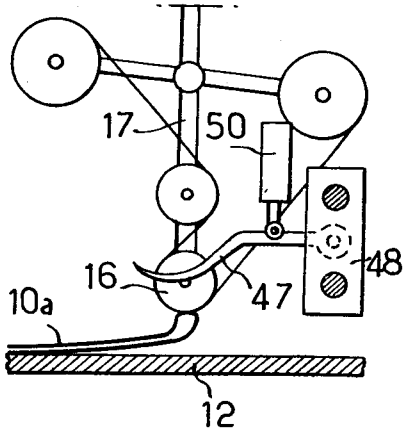
FIGS. 11, 12 and 13 are successive partial side views (similar to FIGS. 3-5) of the apparatus shown in FIG. 10 respectively sharing three successive phases of transfer of one element.

The elements common to the apparatus shown by FIGS. 1 and 10 have the same reference numbers and will not be described again.

Figure 11:
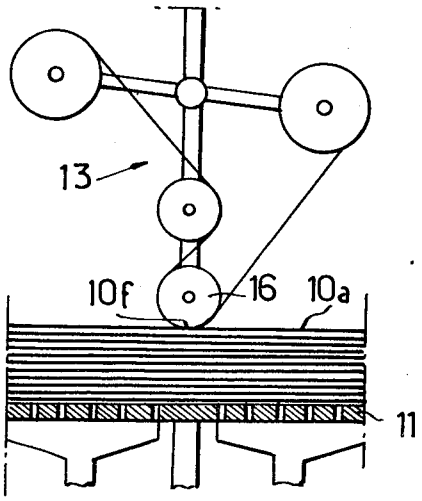

The apparatus shown in FIG. 10 is distinguished from that shown in FIG. 1 in that it does not have the separation device and in that in its rear position the gripping heads 13 overhang the elements 10 stacked on the platform 12 with their gripping fingers 16 aligned in a vertical plane comprising the line 10*f*, along which the elements 10 must be folded The gripping heads 13 being in the rear position, the gripping fingers 16 are lowered by the jacks 18 and are applied to the first element 10*a* along its fold line 10*f* (FIG. 11).

Figure 12:
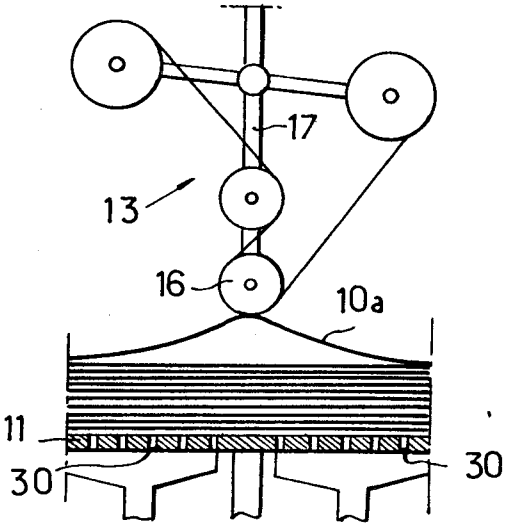

The gripping fingers 16 are thus raised and take along with them element 10*a* (FIG. 12). It will be noted that this embodiment of the apparatus is reserved for textile elements which when stacked do not stick together but nevertheless it is preferable to provide suction orifices 30 in the platform 11 possibly in its central part.

When the gripping 16 are in the high position the gripping heads 13 are displaced towards their forward position above the table 12. As soon as they have reached this, the element 10*a* is located folded along the line 10*f* and is detached from the gripping fingers 16 by means of take-off arms 47 lowered by the jacks 50 and the assembly and functioning of which are asdescribed with reference to FIGS. 1 and 5. The arms 47 maintaining the transferred elements 10*a* on the table 12, the gripping heads are brought into the rear position.

As above, the platform 11 is displaced vertically in order to bring the first element of the stack to the level of the table 12. A pneumatic control circuit for the apparatus shown in FIG. 10 may be simply derived from that shown in FIG. 6 by deleting the jacks 43 and 46.

FIGS. 14 to 17 show another embodiment of an apparatus in accordance with the invention for taking hold of elements folded in two and placing them still folded on a table.

Figure 14:
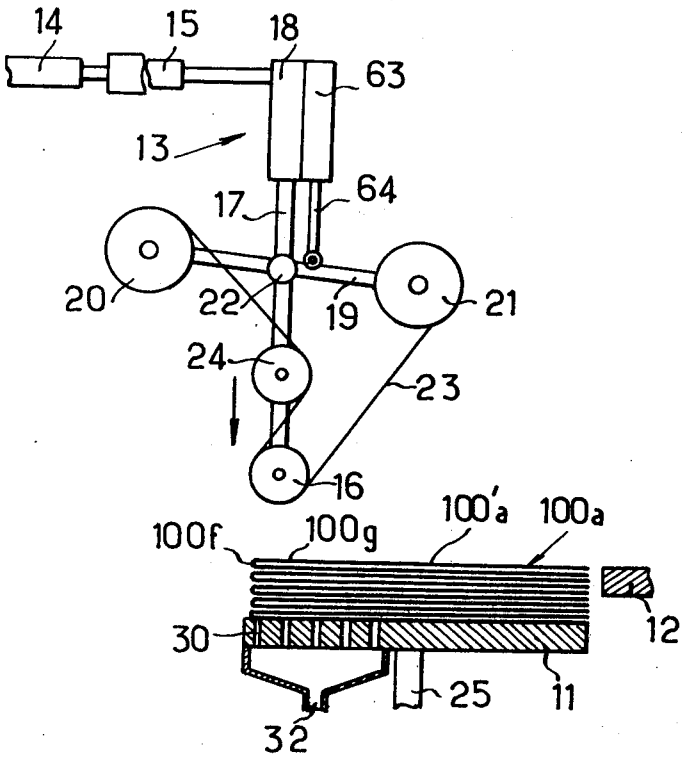
FIG. 14 is a partial elevational side view also in section of an embodiment of an apparatus in accordance with the invention for the transfer of elements folded in half and picked up from a stack and moved folded in half on to a table.

The elements common to the apparatus shown in FIGS. 1 and 14 have the same reference numbers.

Elements 100 rest in a stack and are folded in two on the platform 11 having suction orifices 30 at least along its edge 11*b* opposite edge 11*a* situated on the side of the table 12. As above, the platform is able to be moved vertically in order to bring the first element 100*a* of the stack to the level of the table 12.

The elements 100 are arranged on the platform 11 with their fold line 100*f* situated along the side 11*b*.

Figure 15:
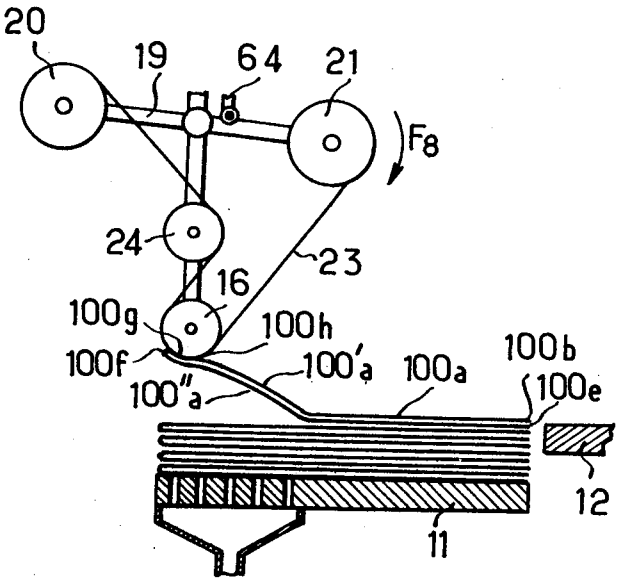
FIGS. 15, 16 and 17 are successive partial side views (similar to FIGS. 3-5) of the apparatus shown in FIG. 14 at the time of three successive phases of transfer of one element.

The gripping heads 13 occupy, in their rear position, a position such that the gripping fingers 16 overhang the region 100*g* of the upper part 100'*a* of the element 100*a* adjacent the line of fold 100*f*. When the gripping fingers are brought into the gripping position by the jacks 18 and then raised again, they take hold of the element 100*a*, each on a part of the region 100*g* extending between the fold 100*f* and a point 100*h* of the upper part 100'*a* of the element 100*a* (FIG. 15).

It may be stated that if the gripping heads 13 are then horizontally displaced towards the table 12, turn-round of 100*a* is brought about. During this turning round process its upper part 100'*a* pivots around the points 100*h* aligned parallel to the fold 100*f* while its lower part 100''*a* pivots about the fold 100*f*. Thus a relative shifting between the edges 100*b*, 100*e* which did not exist when this element rested on the platform 11 will be observed on the element which has been turned around and transferred on to the table 12.

Figure 16:
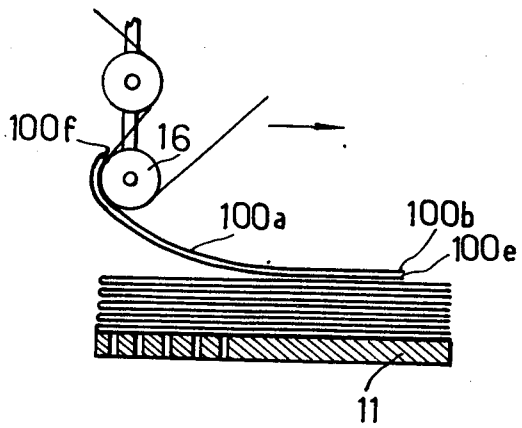

In order to remedy this disadvantage either after or at the time of raising the gripping fingers 16 the fold 100*f* is displaced so that the two parts 100'*a* and 100''*a* of the element 100*a* cannot slide in relation to each other during transfer of the element 100*a*. This is carried out by pivoting the arm 19 of each gripping head 13 about the axis 22 in the direction of the arrow $F_8$ (FIG. 15) by means of a jack 63 carried by the gripping head and the rod 64 of which is articulated on the arm 19. By this pivot movement, the parts of the element 100*a* which have been connected to the adhesive strips 22 slide on the gripping fingers 16 over a length corresponding substantially to that of the shift mentioned above, the fold 100*f* coming above the axis of the gripping fingers 16 (FIG. 16).

After pivoting the arms 19, the gripping heads are displaced towards their forward position by the jacks 14.

Close to the table 12 is mounted the retaining device for the transferred elements which is identical to that shown in FIG. 7 and the elements of which have the same reference numbers.

Figure 17:
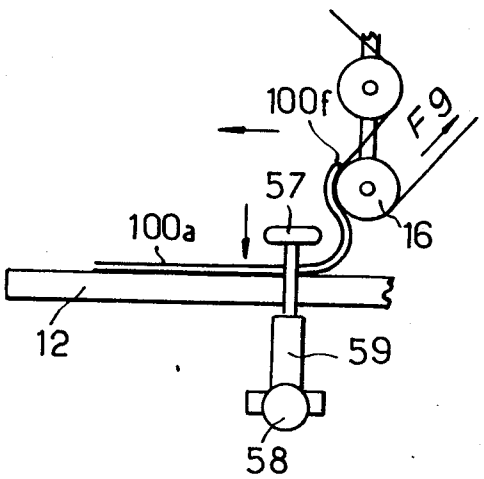

When the gripping heads 13 have reached the forward position, the bar 57 is brought by the jack 58 above the transferred element 100*a* close to the gripping fingers 16 and is then applied to this element by the jack 59 (FIG. 17).

At the time of return of the gripping heads 13, the transferred element 100*a* is detached from the gripping fingers 16. The bar 57 is then raised again and withdrawn by the jacks 59 and 58 in order to permit the transferred element to be discharged. Preferably, the arms 19 are brought into the initial position by the jacks 63 as soon after application of the bar to the transferred element as possible while the gripping heads 13 are in the forward position. This causes sliding of the adhesive strip (arrow $F_9$ of FIG. 17) and return of the fold 100*f* under the gripping finger. This arrangement makes it possible to remove the element 100*a* when the gripping fingers 16 return.

Figure 18:
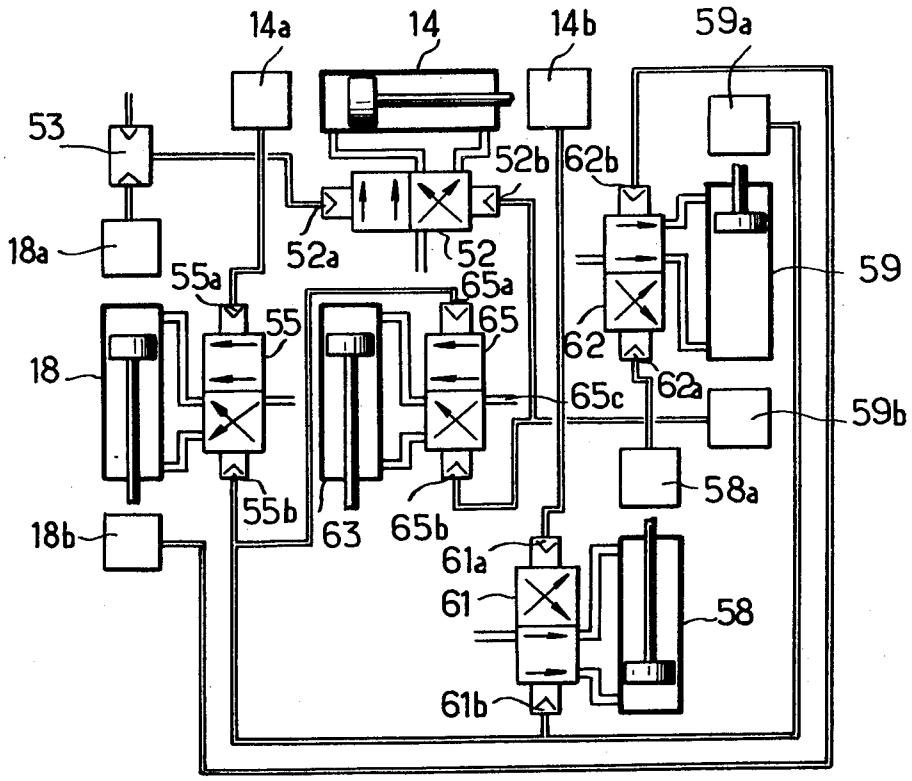
FIG. 18 is a circuit diagram for pneumatic control of the plant shown in FIG. 14.

FIg. 18 illustrates a pneumatic control diagram of the plant shown in FIG. 14.

The circuit elements common to the circuits of FIGS. 6, 9 and 18 have the same reference numbers.

The jacks 18 are supplied by the distributor 55 which receives the signals of the detectors 14*a* and 59*a* at its control inputs 55*a* and 55*b*.

The jacks 14 are supplied by the distributor 52 which receives the output signal from the AND-circuit 53 and the signal from the detector 59*a* at its inputs 52*a* and 52*b*. The AND-gate 53 has its inputs connected to the detector 18*a* and to a start-stop valve (not shown).

The jack 58 is supplied by the distributor 61, the inputs 61*a* and 61*b* of which are connected to the detectors 14*b* and 59*a*, while the jack 59 is supplied by the distributor 62, the inputs 62*a* and 62*b* of which are connected to the detectors 58*a* and 18*b*.

Finally the jacks 63 are supplied by a distributor 65 connected to the source of air under pressure by a pipe 65*c* and its control inputs 65*a* and 65*b* are connected respectively to the detector 59*a* and to the detector 59*b*.

Functioning of the apparatus shown in FIG. 14 by this control circuit is such as described above. Arms 19 pivot in the direction of the arrow $F_8$ (FIG. 15) at the same time as the gripping fingers are raised again and return to their initial position as soon as the bar 57 is applied to the table 12.

For each of the embodiments of a plant in accordance with the invention described above, an automatic advance device for each adhesive strip 23 could be provided making it possible to bring a new portion of adhesive strip under each gripping finger 16 each time an element is transferred.

Such an automatic advance device comprises, for each gripping head 13, for example an integral ratchet wheel (not shown) rotating with the rewinding roller 21 and cooperating with a catch so as to be able to turn solely in the direction corresponding to extraction of the strip 23 wound on to the take up roller 20. Rotation of the ratchet wheel and thus of the rewinding roller 21 is controlled by a wheel 66 (shown only in FIGS. 1 and 2), which is fixed for rotation with this ratchet wheel and carries a cam 67 which comes into contact with an abutment 68 (shown only in FIG. 1) when the gripping head reaches its high position after gripping an element. When the cam 67 comes into contact with the abutment 68 this causes rotation of the wheel 66 by a fraction of a turn and thus a new portion of adhesive strip is brought under the gripper finger 16, the said adhesive strip being unwound from the roller 20 mounted on a wheel having a free brake.

It will be noted that for each element transferred, it is useful to bring a new portion of adhesive strip underneath each gripping finger 16, the length of which is only a fraction of the effective length of the adhesive strip actually in contact with an element at the time of transfer.

Of course different modifications or additions may be made to the embodiments and methods of implementation described above of an apparatus in accordance with the invention without going beyond the framework of protection defined by the attached Claims. It will be noted particularly that the apparatus shown in FIG. 1 modified in accordance with FIG. 7, i.e. comprising a bar which is movable horizontally and vertically as a retention device for the elements transferred and in accordance with FIG. 14 i.e. comprising jacks for controlling the pivot movement of the arms 19, may be suitable for all the modes of transfer of elements referred to above on condition, depending on the case, of putting into and out of service the separation device 33 and possibly the jacks 63, of controlling the rear position of the gripping heads 13 and controlling the position of the retaining bar 57.

It will be understood that the above description of the present invention is susceptible to various modification changes and adaptations.

What is claimed is:

1. An automatic transfer apparatus for transferring articles stacked on a platform one by one onto a table, comprising a gripping head including support means, a gripping finger mounted vertical movement relative to said support means, first drive means connected to said support means for moving said support means backwards and forwards over the platform and table between a rear position and a forward position, second drive means for moving said gripping finger vertically relative to said support means from or to a gripping position in which it can contact the article on top of the stack, and adhesive means on said gripping finger for engaging and folding said article on top of the stack; traction means for releasing the hold of said adhesive means when said article has been transferred from said platform to said table; said adhesive means comprising an adhesive strip which is unwound from a first roller and guided by its non-adhesive face over said gripping finger; and a rod carrying said gripping finger at a lower end and an arm carrying said first and second rollers at its ends and pivoted to said rod between its said ends.

2. An apparatus as defined in claim 1, wherein said gripping finger comprises a pulley freely rotatable about a horizontal axis.

3. An automatic transfer apparatus for transferring articles stacked on a platform one by one onto a table, comprising a gripping head including support means, a gripping finger mounted for vertical movement relative to said support means, first drive means connected to said support means for moving said support means backwards and forwards over the platform and table between a rear position and a forward position, second drive means for moving said gripping finger vertically relative to said support means from or to a gripping position in which it can contact the article on top of the stack, and adhesive means on said gripping finger for engaging and folding said article on top of the stack; said drive means for said gripping finger comprising means for bringing said gripping finger into a gripping position on an area adjacent a fold of the first article of the stack resting on the platform; said adhesive means comprising an adhesive strip which is unwound from a first roller, guided by its non-adhesive face over said gripping finger and is taken up again by a second roller; and a rod carrying said gripping finger at a lower end, an arm carrying said first and second rollers at its ends and pivoted to said rod between its ends

4. An automatic transfer apparatus for transferring textile articles such as pieces of knitted wear stacked on support platform one by one onto a table, the apparatus comprising:

at least one gripping head including support means, a gripping finger mounted for vertical movement relative to said support means, first drive means for vertically moving said gripping finger between a gripping position adjacent said platform to a position above the platform, and adhesive means on said gripping finger for engaging by pressure an article on the top of said stack when said gripping finger is in said gripping position.

second drive means for moving said gripping head backwards and forwards over said platform and table between a rear position and a forward position, separating means for separating by pulling a transferred article on said table from said gripping finger during the backwards movement of said gripping finger, and suction means connected to passages formed in said support platform and opening in the upper surface thereof covered by said stack.

5. An apparatus as defined in claim 4, wherein said gripping finger is a roller freely rotatable about an horizontal axis at the lower end of a vertically movable rod carried by said support means, wherein unwinding and rewinding reels are mounted at the ends of an arm mounted on said rod, and wherein said adhesive means comprises an adhesive strip which is guided by its non-adhesive face on said roller on its path between said unwinding and rewinding reels.

6. An apparatus as defined in claim 4, and comprising a means for displacing the support platform vertically and detection means for supplying a stop signal to the displacing means to bring, each time, the first article of the stack resting on the platform just above a predetermined horizontal plane, the upper face of the table being situated substantially in said horizontal plane.

7. An apparatus as defined in claim 4, and comprising a fixed support block having an horizontal upper surface and located adjacent a first edge of said platform opposite the edge of the platform which is on the side of said table, at least one shifting element movable between a first position above said support block upper surface and a second position above an edge region, located on the side of said first edge of the support platform, of the article on the top of said stack, and means for moving said shifting element between said second and first position to shift said top article laterally of the rest of the stack by bringing said edge region of the top article on said upper surface of the support block.

8. An apparatus as defined in claim 7, wherein said suction means are connected at least to first passages formed in the platform and opening in the upper surface thereof in the portion of said platform adjacent said first edge, and to second passages formed in said support block and opening in the upper surface thereof.

9. An apparatus as defined in claim 7, wherein said shifting element comprises a support element, an arm pivotally mounted on said support element, a brush carried by said arm and means for pivoting said arm and thereby alternately lowering and raising said brush between an upper position and a lower position wherein said brush is engaged with said edge region of said top article.

10. An apparatus as defined in claim 4, wherein said first and second drive means comprise means for bringing said gripping finger into a gripping position close to one edge of the articles to be transferred extending transversely in relation to the direction of transfer of these articles; and said separating means comprise a bar movable above said table, first means for displacing said bar transversely of said direction of transfer between a first position, in which said bar is moved aside from the transfer region of the said article onto the table and a second position, in which said bar overhangs said transfer region and is situated on the side of the platform with respect to the forward position of said gripping finger, and second means for applying the bar to the table when it is in the second position, a transferred article applied on the table by said bar being successively folded over said bar and separated from said gripping finger during the backwards movement of said finger.

11. An apparatus as defined in claim 4, wherein said first and second drive means comprise means for bringing said gripping finger into a gripping position on an area adjacent a fold of the first article of a stack resting on the platform.

12. An apparatus as defined in claim 11, wherein said gripping finger is a roller freely rotatable about a horizontal axis at the lower end of a vertically movable rod carried by said support means, wherein unwinding and rewinding reels are mounted between its ends on said rod, wherein said adhesive means comprise an adhesive strip which is guided by its non-adhesive face on said roller on its path between said unwinding and rewinding reels, and wherein means are provided for pivoting said arm with respect to said rod.

* * * * *